US010802421B2

(12) United States Patent
Tojo

(10) Patent No.: US 10,802,421 B2
(45) Date of Patent: Oct. 13, 2020

(54) IMAGE FORMING APPARATUS AND DEVELOPING APPARATUS

(71) Applicant: CANON KABUSHIKI KAISHA, Tokyo (JP)

(72) Inventor: Arata Tojo, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/371,291

(22) Filed: Apr. 1, 2019

(65) Prior Publication Data

US 2019/0317428 A1 Oct. 17, 2019

(30) Foreign Application Priority Data

Apr. 17, 2018 (JP) ..... 2018-079407

(51) Int. Cl.
*G03G 15/08* (2006.01)

(52) U.S. Cl.
CPC ..... *G03G 15/0886* (2013.01); *G03G 15/0865* (2013.01); *G03G 15/0891* (2013.01)

(58) Field of Classification Search
CPC ..... G03G 15/0886; G03G 15/0865; G03G 15/0891
See application file for complete search history.

(56) References Cited

U.S. PATENT DOCUMENTS 5,450,178 A * 9/1995 Kawashima ..... G03G 15/0844 399/254
2012/0002983 A1* 1/2012 Kataoka ..... G03G 15/0863 399/12

FOREIGN PATENT DOCUMENTS

JP 2009-192701 A 8/2009

* cited by examiner

*Primary Examiner* — Gregory H Curran
(74) *Attorney, Agent, or Firm* — Venable LLP

(57) ABSTRACT

An image forming apparatus includes an insertable developing apparatus having a developer container, a developer discharging portion, and a shutter movably arranged between a closing position and an opening position. A first spring joins with the shutter and urges the shutter in an insertion direction in which the developing apparatus is inserted to the image forming apparatus so the shutter is maintained at the closing position, and a fixing member is detachably attached to the developing apparatus and fixes the shutter at the closing position. An attachment portion in the developing apparatus attaches to the fixing member, an engagement member engages with the shutter, and a second spring joins with the engagement member and urges the engagement member in a direction opposite to the insertion direction.

3 Claims, 9 Drawing Sheets

IMAGE FORMING APPARATUS AND DEVELOPING APPARATUS

BACKGROUND OF THE INVENTION

Field of the Invention

The present invention relates to a developing apparatus and an image forming apparatus, such as printers, copying machines, facsimiles, and multifunction printers, which uses the electrophotographic technology.

Description of the Related Art

Image forming apparatus uses two-component developer (hereinafter simply referred to as developer) containing non-magnetic toner and magnetic carrier, to develop an electrostatic latent image formed on a photosensitive drum, into a toner image. For the image forming apparatus, as described in Japanese Patent Application Publication No. 2009-192701, a so-called trickle system is proposed to supply supplying developer while preventing deterioration of the developer. In the trickle system, while the supplying developer is supplied from a supplying apparatus, deteriorated developer is discharged out of a developer container.

Carrier particles of the developer container are easily cracked or chipped while agitated and conveyed by conveyance screws. Such carrier is deteriorated in toner charging capability. As the deteriorated carrier increases, the amount of charge of the toner charged by the carrier decreases, easily causing image defects. Thus, to supply the toner by the amount of toner consumed in the development and supply the carrier to maintain the toner charging capability, the supplying developer contains toner and carrier.

By the way, since the carrier is higher than the toner in production cost, the trickle system involves higher running costs because of supplying the carrier. Thus, some users may desire to operate a costless system (referred to as a non-trickle system for convenience) by supplying only the toner without supplying the carrier. The users, however, may occasionally desire to operate the trickle system, regardless of costs, for eliminating image defects. However, since the conventional apparatus operate on either one of the trickle system and the non-trickle system, the apparatus have no multiplicity of use, and hardly satisfy a variety of user needs as described above.

In another aspect, since the trickle system has a discharge port to discharge the deteriorated developer, such a difference in configuration obstructs standardization of components used in the developing apparatus with the trickle system and the developing apparatus with the non-trickle system.

SUMMARY OF THE INVENTION

According to a first aspect of the present invention, an image forming apparatus includes an apparatus body, a developing apparatus detachably attached to the apparatus body and including a developer container, configured to store developer containing non-magnetic toner and magnetic carrier, with a discharge port through which the developer in the developer container is discharged, a shutter configured to move between an opening position and a closing position, the opening position being a position at which the shutter opens the discharge port, the closing position being a position at which the shutter closes the discharge port, and a shutter urging member configured to urge the shutter so that the shutter is positioned at the closing position, an abutment member movably disposed on the apparatus body, and configured to abut against the shutter when the developing apparatus is inserted and push the shutter toward a direction opposite to a direction in which an urging force of the shutter urging member is applied, and a fixing member detachably attached to the developing apparatus and configured to fix the shutter at the closing position so that the shutter is positioned at the closing position and the abutment member is located, by being pushed by the fixed shutter, at a position moved in an insertion direction of the developing apparatus in a state where the developing apparatus is attached to the apparatus body.

According to a second aspect of the present invention, an image forming apparatus includes an apparatus body, a developing apparatus detachably attached to the apparatus body and including a developer container, configured to store developer containing non-magnetic toner and magnetic carrier, with a discharge port through which the developer in the developer container is discharged, a shutter configured to move between an opening position and a closing position, the opening position being a position at which the shutter opens the discharge port, the closing position being a position at which the shutter closes the discharge port, and a shutter urging member configured to urge the shutter so that the shutter is positioned at the closing position, an abutment member movably disposed on the apparatus body, and configured to abut against the shutter and push the shutter toward a direction when the developing apparatus is inserted, the direction being opposite to a direction in which an urging force of the shutter urging member is applied, and a restricting member detachably attached to the developing apparatus and configured to restrict the abutment member from being positioned at such a position that the abutment member moves the shutter to the opening position when the developing apparatus is attached to the apparatus body.

According to a third aspect of the present invention, a developing apparatus configured to be inserted into and attached to an image forming apparatus includes a developer container, configured to store developer containing non-magnetic toner and magnetic carrier, with a discharge port through which the developer in the developer container is discharged, a shutter configured to move between an opening position and a closing position, the opening position being a position at which the shutter opens the discharge port, the closing position being a position at which the shutter closes the discharge port, a shutter urging member configured to urge the shutter toward the closing position, and an attachment portion to which an obstructing member, configured to obstruct the shutter from moving from the closing position to the opening position is attached.

Further features of the present invention will become apparent from the following description of exemplary embodiments with reference to the attached drawings.

DESCRIPTION OF THE EMBODIMENTS

First Embodiment

Image Forming Apparatus

Figure 1:
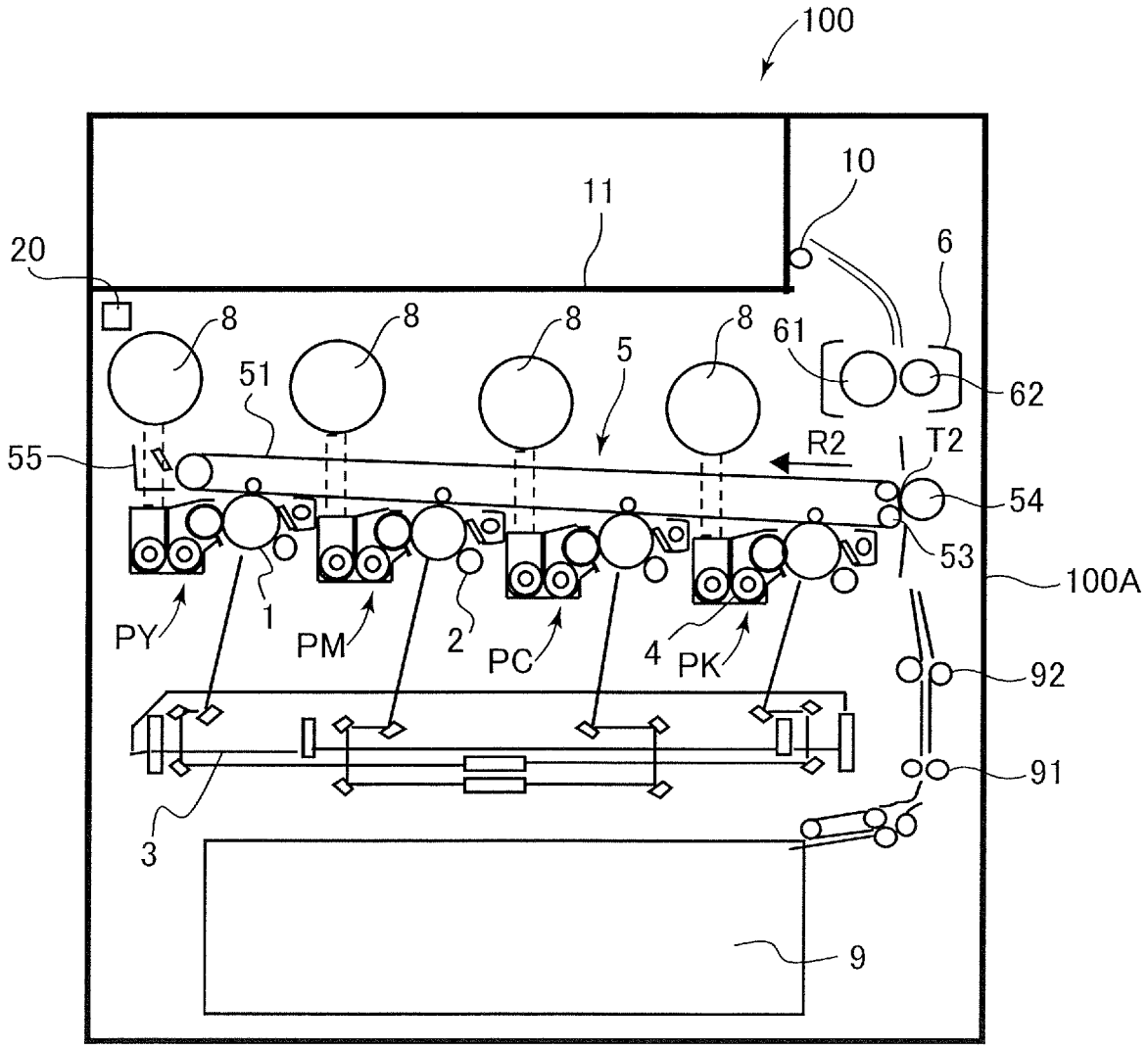
FIG. 1 is a schematic diagram illustrating an image forming apparatus of a first present embodiment.

A first embodiment will be described. First, a schematic configuration of an image forming apparatus of the present embodiment will be described with reference to FIGS. 1 and 2. An image forming apparatus 100 of the present embodiment is a tandem-type full-color electrophotographic image forming apparatus. The image forming apparatus 100 can form a full-color image on a recording material in accordance with an image signal sent from a document reading apparatus (not illustrated) connected with an apparatus body 100A, or from an external device (not illustrated), such as a personal computer, communicatively connected with the apparatus body 100A. The recording material may be a sheet material, such as a paper sheet, a plastic film, or a cloth sheet.

The image forming apparatus 100 includes image forming portions PY, PM, PC, and PK which respectively form images of yellow, magenta, cyan, and black. Above the image forming portions PY to PK, an intermediate transfer apparatus 5 is disposed. The intermediate transfer apparatus 5 is configured such that an endless intermediate transfer belt 51 is wound around a plurality of rollers and moved in a direction indicated by an arrow R2. The intermediate transfer belt 51 moves while carrying a toner image, which is primary-transferred from a photosensitive drum 1 to the intermediate transfer belt 51 as described later. A secondary transfer inner roller 53 is one of the rollers around which the intermediate transfer belt 51 is wound; and at a position facing the secondary transfer inner roller 53 via the intermediate transfer belt 51, a secondary transfer outer roller 54 is disposed. The secondary transfer inner roller 53 and the secondary transfer outer roller 54 form a secondary transfer portion T2 in which the toner image formed on the intermediate transfer belt 51 is secondary-transferred onto the recording material.

In a lower portion of the image forming apparatus 100, there is disposed a cassette 9 which stores the recording material. The recording material fed from the cassette 9 is conveyed by a conveyance roller 91 toward a registration roller 92. When the leading edge of the recording material abuts against the registration roller 92 which is in a stop state, a loop is formed in the recording material to correct skew of the recording material. Then the registration roller 92 rotates in synchronization with the formation of the toner image on the intermediate transfer belt 51, and the recording material is conveyed to the secondary transfer portion T2.

Next, a full-color image forming process by the image forming apparatus 100 will be described. Here, the four image forming portions PY to PK of the image forming apparatus 100 have substantially the same configuration, except that they have different developing colors from each other. Thus, in the following description, the image forming portion PK used for black will be described as an example, and the description for the other image forming portions PY, PM, and PC will be omitted.

Figure 2:
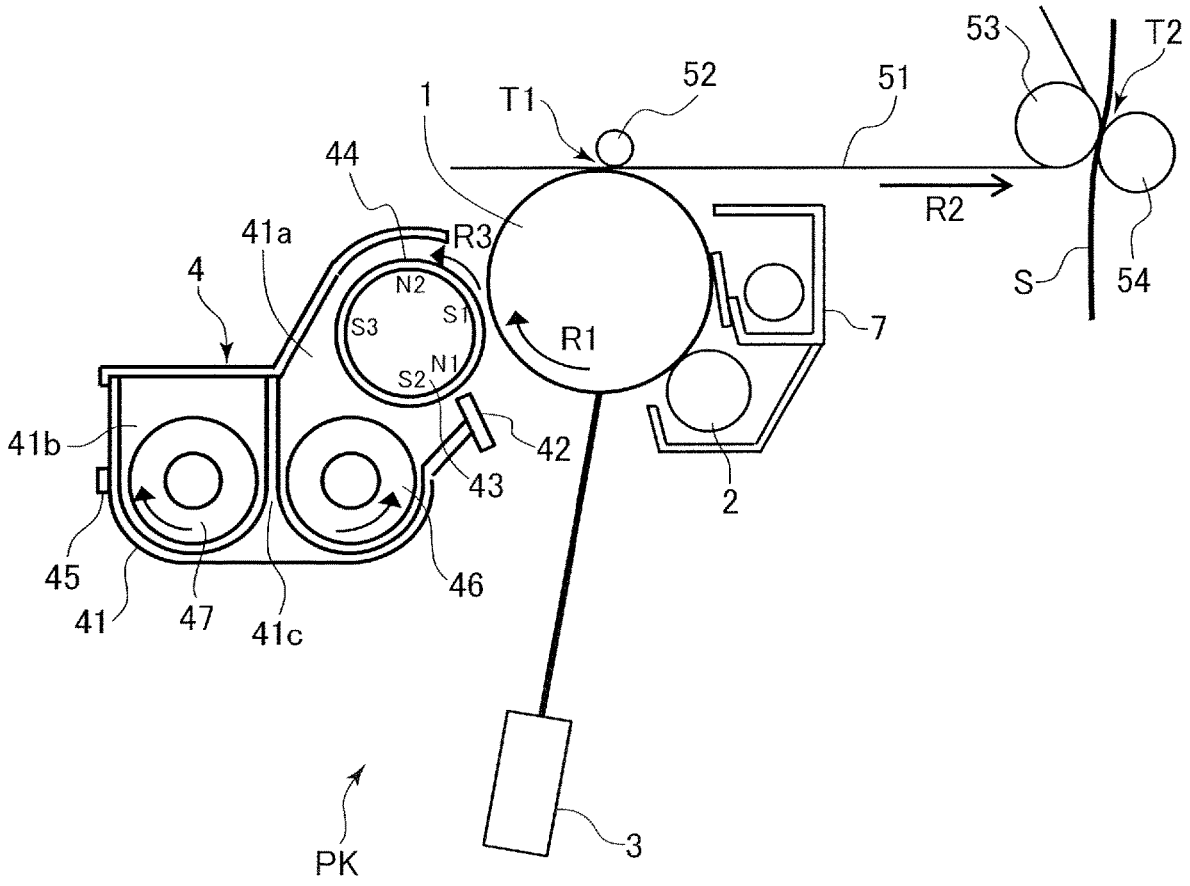
FIG. 2 is a schematic diagram illustrating an image forming portion and its surroundings.

As illustrated in FIG. 2, the image forming portion PK includes the photosensitive drum 1 which can rotate. The photosensitive drum 1 is rotated in a direction indicated by an arrow R1 of FIG. 2. Around the photosensitive drum 1, a charging apparatus 2, an exposure apparatus (laser scanner) 3, a developing apparatus 4, a primary transfer roller 52, and a cleaning apparatus 7 are disposed.

The photosensitive drum 1 starts to rotate at the start of the image forming operation, and the surface of the photosensitive drum 1 is uniformly charged by the charging apparatus 2. The photosensitive drum 1 is then scanned by and exposed to a laser beam emitted from the exposure apparatus 3 and corresponding to an image signal. With this operation, an electrostatic latent image is formed on the photosensitive drum 1 in accordance with the image signal. The electrostatic latent image formed on the photosensitive drum 1 is developed into a toner image by using the two-component developer (specifically, toner) contained in the developing apparatus 4. In the present embodiment, the developing apparatus 4 is detachably attached to the apparatus body 100A. The developing apparatus 4 will be described later.

The toner image formed on the photosensitive drum 1 is primary-transferred onto the intermediate transfer belt 51 in a primary transfer portion T1. The primary transfer portion T1 is formed between the photosensitive drum 1 and the primary transfer roller 52. The primary transfer roller 52 is disposed at a position at which the primary transfer roller 52 faces the photosensitive drum 1 via the intermediate transfer belt 51, and is applied with a primary transfer bias. The toner left on the photosensitive drum 1 after the primary transfer is removed by the cleaning apparatus 7.

Such operations are performed sequentially in each of the image forming portions PY to PK of yellow, magenta, cyan, and black; and four-color toner images are superposed on each other on the intermediate transfer belt 51. In synchronization with the formation of the toner image, the recording material stored in the cassette 9 is conveyed to the secondary transfer portion T2. After that, by applying a secondary transfer bias to the secondary transfer outer roller 54, the four-color toner image on the intermediate transfer belt 51 is secondary-transferred onto the recording material. The toner not transferred in the secondary transfer portion T2 and left on the intermediate transfer belt 51 is removed by an intermediate transfer belt cleaner 55.

The recording material onto which the toner image has been secondary-transferred is conveyed to a fixing apparatus 6. The fixing apparatus 6 includes a fixing roller 61 and a pressure roller 62, which form a fixing nip portion. Here, the fixing roller 61 may be a film or a belt, and the pressure roller 62 may be a belt. When passing through the fixing nip portion, the recording material is heated and pressurized. With this operation, the toner on the recording material is melted, mixed, and fixed to the recording material as a full-color image. The recording material is then discharged to a discharging tray 11 by a discharge roller 10. With this operation, a series of image forming processes are completed.

Here, the image forming apparatus 100 of the present embodiment may select any of the four image forming portions PY to PK, and thereby may form a monochrome black image or a multi-color image in which any of the four colors are combined.

In addition, in the present embodiment, a supplying apparatus 8 is disposed above the developing apparatus 4 of each of the image forming portions PY to PK. In each of the image forming portions PY to PK, the supplying apparatus 8 supplies the supplying developer to the developing apparatus 4, depending on an average value (average image ratio) of image ratios of formed images, or on a detection signal from a permeability sensor 45 (see FIG. 2) or a density sensor (not illustrated). The permeability sensor 45 detects the toner density of the developer of the developing apparatus 4, and the density sensor detects the density of a patch image which is formed on the intermediate transfer belt 51 and used to adjust the density.

Developing Apparatus

Next, a schematic configuration of the developing apparatus 4 will be described with reference to FIGS. 2 and 3. The developing apparatus 4 includes a developer container 41 which contains the two-component developer (simply referred to as developer) having non-magnetic toner and magnetic carrier. That is, the present embodiment uses a two-component developing method as the developing method, and uses the developer in which the non-magnetic toner with negative polarity is mixed with the magnetic carrier with positive polarity. As one example, the non-magnetic toner may be powders made through pulverization or polymerization, and made of resin, such as polyester or acrylic-styrene resin. The powders contain coloring agent and wax component, and surfaces of the powders are added with fine powders made of titanium oxide or silica. The magnetic carrier may be particles, each having a resin core in which ferrite particles or magnetic powders are mixed, and which is coated with resin.

As illustrated in FIG. 2, the developer container 41 has a developing area, which faces the photosensitive drum 1 and is opened. In the opening, a developing sleeve 44 is rotatably disposed and partly exposed from the opening. Inside the developing sleeve 44, a magnet roll 43 is disposed so as not to rotate. The magnet roll 43 has a plurality of magnetic poles positioned along the circumferential direction of the magnet roll 43. The developing sleeve 44 is made of non-magnetic material. When the developing operation is performed, the developing sleeve 44 rotates in a direction indicated by an arrow R3 of FIG. 2, and carries the developer to the developing area.

Figure 3:
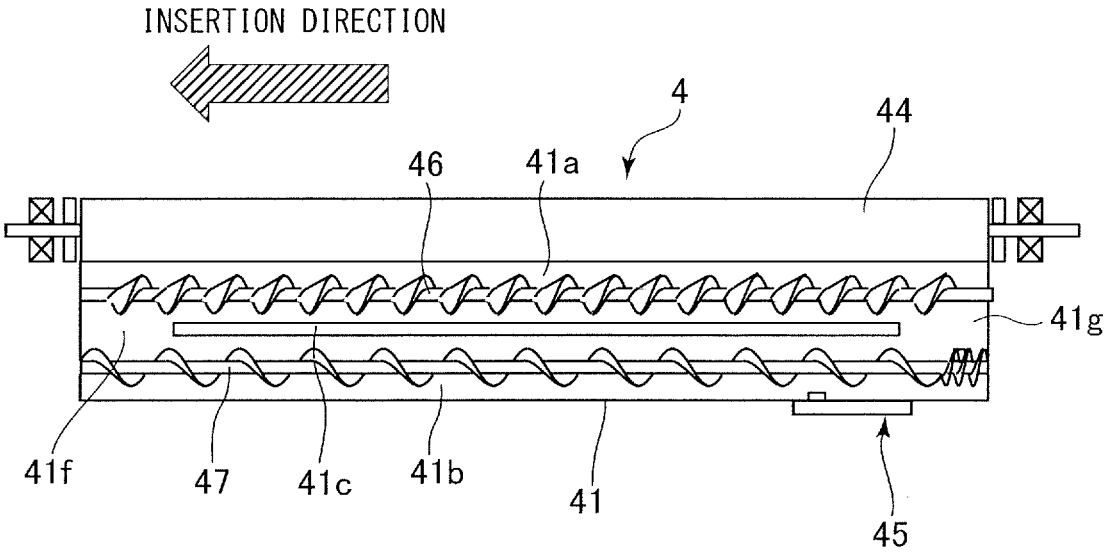
FIG. 3 is a cross-sectional view of an upper portion of a developing apparatus, taken along a horizontal plane extending in an axial direction.

As illustrated in FIG. 3, the developer container 41 has a developing chamber 41*a* and an agitating chamber 41*b*. The developing chamber 41*a* and the agitating chamber 41*b* contain the developer, and form a circulation path, along which the developer is circulated. The developer container 41 is partitioned into the developing chamber 41*a* and the agitating chamber 41*b* by a partition wall 41*c*. Here, the developing chamber 41*a* and the agitating chamber 41*b* communicate with each other via communicating openings 41*f* and 41*g* formed at both end portions of the developer container 41 in the longitudinal direction (i.e. at right and left sides in FIG. 3).

The developing chamber 41*a* has a developing screw 46, and the agitating chamber 41*b* has an agitating screw 47. Each of the developing screw 46 and the agitating screw 47 has a spiral blade formed around its rotation shaft, and conveys the developer while agitating the developer in the developer container 41. The developer of the developing chamber 41*a* is moved leftward in FIG. 3 while agitated by the developing screw 46, and delivered from the developing chamber 41*a* to the agitating chamber 41*b* through the communicating opening 41*f* On the other hand, the developer of the agitating chamber 41*b* is moved rightward in FIG. 3 while agitated by the agitating screw 47, and delivered from the agitating chamber 41*b* to the developing chamber 41*a* through the communicating opening 41*g*. In this manner, the developer is circulated in the developer container 41 while agitated by the developing screw 46 and the agitating screw 47. In the present embodiment, a developer conveyance direction of the developing screw 46 is equal to a direction toward which the developing apparatus 4 is inserted, and a developer conveyance direction of the agitating screw 47 is opposite to the direction toward which the developing apparatus 4 is inserted.

The developer of the developing chamber 41*a* is partly supplied to the developing sleeve 44 while conveyed by the developing screw 46. The developer supplied to the developing sleeve 44 is then carried by the developing sleeve 44, by a predetermined amount, due to a magnetic field generated by the magnet roll 43; and thereby an accumulated developer is formed on the developing sleeve 44. The thickness of the accumulated developer formed on the developing sleeve 44 is regulated by a developing blade 42 when the developing sleeve 44 is rotated, and then the developer supplied to the developing sleeve 44 is conveyed to the developing area that faces the photosensitive drum 1. In the developing area, the developer on the developing sleeve 44 is napped to form magnetic brush. When the magnetic brush contacts the photosensitive drum 1, the toner of the developer is supplied to the photosensitive drum 1, and thereby the electrostatic latent image on the photosensitive drum 1 is developed as a toner image. In this time, the developing sleeve 44 is being applied with a developing bias, in which an alternate-current voltage may be added with a direct-current voltage.

In addition, in a portion of the agitating chamber 41*b* located upstream in the developer conveyance direction of the agitating screw 47, a supplying inlet (not illustrated) is formed to supply the supplying developer from the supplying apparatus 8 to the agitating chamber 41*b*. The supplying developer supplied to the agitating chamber 41*b* through the supplying inlet is agitated and conveyed in the agitating chamber 41*b* by the agitating screw 47, together with the developer delivered from the developing chamber 41*a* to the agitating chamber 41*b*.

ACR Control and ATR Control

When the developing operation is performed by using the two-component developer, not only the toner is consumed for forming toner images, but also the carrier may be deteriorated. When the carrier is deteriorated, the charging capability for the toner deteriorates. As a result, when images are formed, image defects, such as the change in density, toner fly, and toner fog, will be easily caused. To avoid such image defects, auto carrier refresh (ACR) control is performed. In the ACR control, depending on a detection signal from the permeability sensor 45 (see FIG. 2), the carrier is refreshed by replacing some of the carrier, while the toner is supplied. In this case, the supplying developer containing toner and carrier is supplied from the supplying apparatus 8. The toner and the carrier are mixed with each other, and the weight ratio of the toner to the carrier may be 9:1.

On the other hand, as described above, since the carrier is higher than the toner in production cost, the ACR control involves higher running costs for supplying the carrier. Thus, some users may desire to operate the costless system by supplying only the toner without supplying the carrier. For achieving the system, automatic toner replenisher (ATR) control is performed. In the ATR control, depending on a detection signal from the density sensor, only the toner is supplied without supplying the carrier. In this case, the supplying developer contains only the toner, and is supplied from the supplying apparatus 8. In the present embodiment, a control unit 20 which controls the supplying apparatus 8 (see FIG. 1) can perform the ACR control and the ATR control. The ACR control is a first mode in which the supplying developer containing the non-magnetic toner and the magnetic carrier is supplied to the developer container, and the ATR control is a second mode in which the supplying developer containing only the non-magnetic toner is supplied to the developer container. As described in detail later, in the present embodiment, a user can select either one of the ACR control, which achieves the trickle system, and the ATR control, which achieves the non-trickle system. That is, in the present embodiment, the control unit 20 can selectively perform one of a plurality of modes including the first mode and the second mode.

Figure 4:
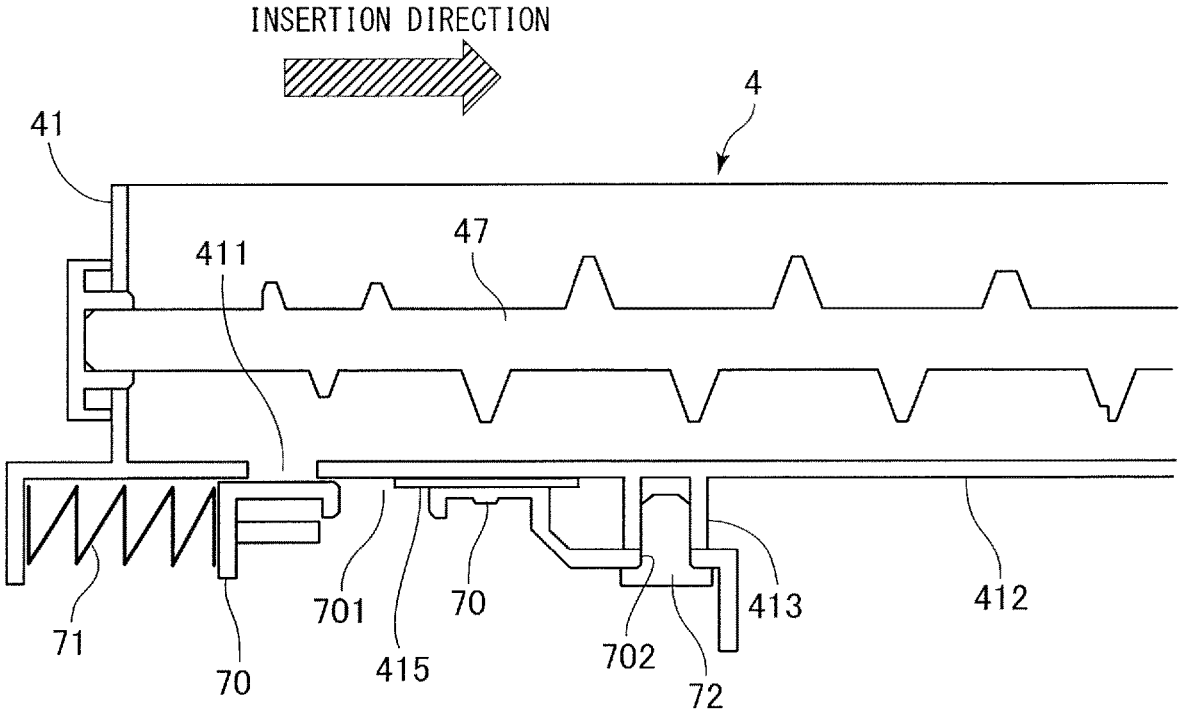
FIG. 4 is an enlarged cross-sectional view illustrating a developing apparatus of the first embodiment.

The developing apparatus 4 of the first embodiment will be described in detail below. FIG. 4 illustrates the developing apparatus 4 of the first embodiment. In a portion of the agitating chamber 41*b* located downstream in the developer conveyance direction of the agitating screw 47 of the agitating chamber 41*b*, a discharge port 411 is formed. In the ACR control, when the supplying developer is supplied to the agitating chamber 41*b* through the supplying inlet, excess developer which contains deteriorated carrier is discharged from the discharge port 411. Here, in the present embodiment, the discharge port 411 is formed in a bottom portion 412 of the developer container 41, as an example. The present disclosure, however, is not limited to this. For example, the discharge port 411 may be formed in a side wall of the developer container 41 at a position with a predetermined height.

Shutter

A shutter 70 is disposed to open or close the discharge port 411. The shutter 70 is joined with a shutter urging spring 71. Thus, when the developing apparatus 4 is inserted or removed, the shutter 70 can slide between a position (hereinafter simply referred to also as a closing position) at which the shutter 70 closes the discharge port 411 and a position (hereinafter simply referred to also as an opening position) at which the shutter 70 opens the discharge port 411. More specifically, the shutter 70 is guided by a guide portion 415, so as to move along the insertion direction of the developing apparatus 4. The shutter urging spring 71, which is a shutter urging member, urges the shutter 70 so that the shutter 70 is positioned at the position at which the shutter 70 closes the discharge port 411. In the present embodiment, the shutter urging spring 71 urges the shutter 70 toward the insertion direction of the developing apparatus 4. The shutter 70 has a shutter opening 701. When the shutter 70 is positioned at the position at which the shutter 70 closes the discharge port 411, the shutter opening 701 is not aligned with the discharge port 411, and thus the developer is not discharged from the discharge port 411. On the other hand, when the shutter 70 is positioned at the position at which the shutter 70 opens the discharge port 411, the shutter opening 701 is aligned with the discharge port 411, and thus the developer is discharged from the discharge port 411.

The shutter 70 can be fixed at the position at which the shutter 70 closes the discharge port 411, by using a fixing member 72 which is a movement restricting member (a restricting member). In other words, the fixing member 72 is an obstructing member which obstructs the shutter 70 from moving from the closing position to the opening position. The shutter 70 may have a circular fixing hole 702 formed downstream from the shutter opening 701 in the insertion direction of the developing apparatus 4. On the other hand, the developer container 41 may have a cylindrical fitting portion 413 which protrudes from the bottom portion 412 toward the shutter 70. When the shutter 70 is positioned at the position at which the shutter 70 closes the discharge port 411, the fitting portion 413 is aligned with the fixing hole 702. The fixing member 72 can be detachably attached to the developer container 41. Thus, in a state where the fixing member 72 is attached to the developer container 41, the fixing member 72 fixes the shutter 70 at the position at which the shutter 70 closes the discharge port 411. The fixing member 72 can be attached to the developer container 41 by inserting the fixing member 72 into the fitting portion 413 through the fixing hole 702 in a state where the fitting portion 413 is aligned with the fixing hole 702. That is, the fitting portion 413 and the fixing hole 702 constitute a fitting portion that fixes the fixing member 72, which is the obstructing member. In contrast, in a state where the fixing member 72 is not attached to the developer container 41, when the developing apparatus 4 is inserted, the shutter 70 is allowed to move from the closing position toward the opening position. That is, when the fixing member 72 is not attached to the developer container 41, the shutter 70 can move relative to the developer container 41. Here, the shutter 70 is urged by the shutter urging spring 71 toward the position at which the shutter 70 closes the discharge port 411. Thus, when the fixing member 72 is not attached to the developer container 41, the discharge port 411 is closed by the shutter 70. Thus, the fixing member 72 is a switching member, which switches the state of the shutter 70 between a state where the shutter 70 can move to the opening position when the developing apparatus 4 is inserted, and a state where the shutter 70 is retained at the closing position when the developing apparatus 4 is inserted.

Figure 5:
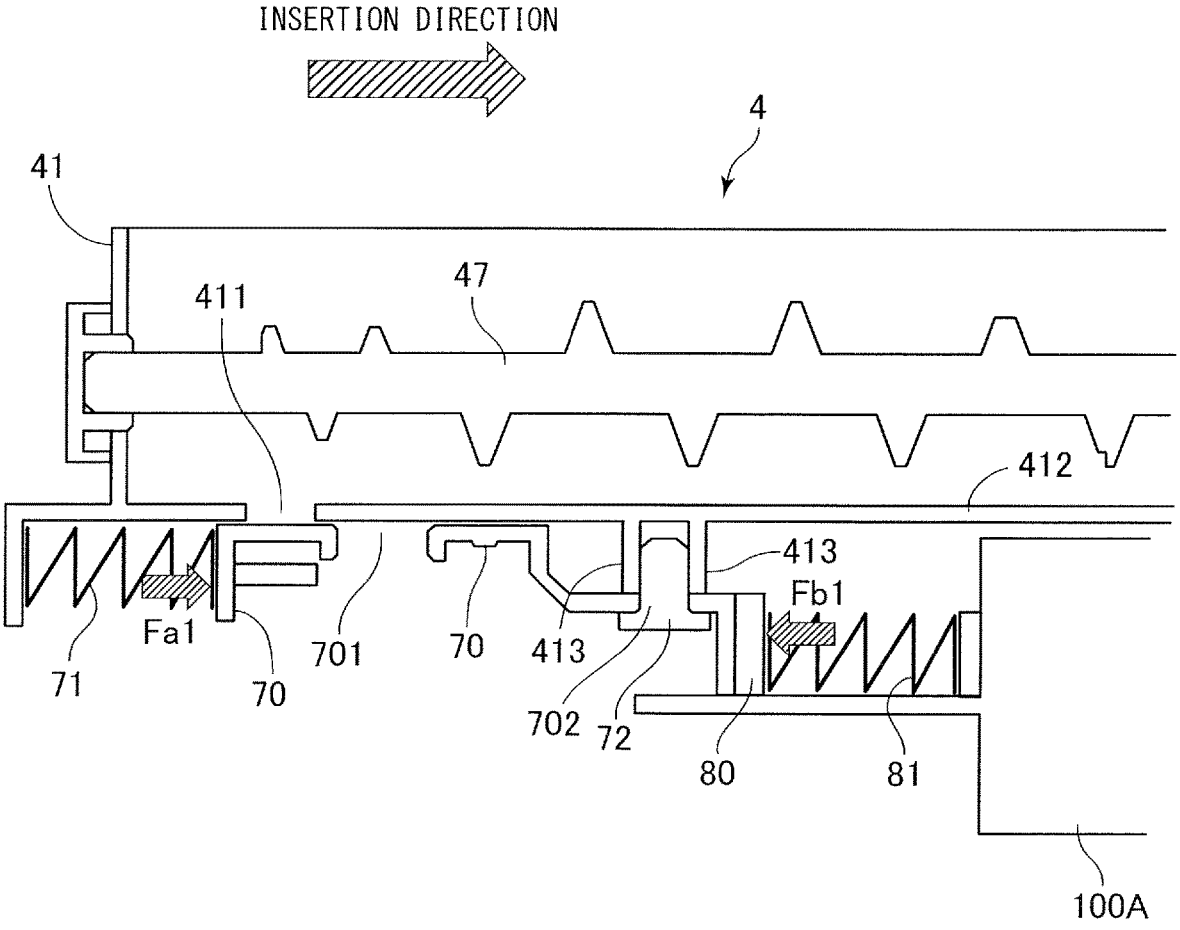
FIG. 5 is a diagram illustrating a shutter operation performed in a state where a fixing member is attached.

Next, an operation of the shutter 70 of the developing apparatus 4 will be described with reference to FIGS. 5 and 6. FIG. 5 illustrates a shutter operation performed in a state where the fixing member 72 is attached, and FIG. 6 illustrates a shutter operation performed in a state where the fixing member 72 is not attached.

As illustrated in FIG. 5, the apparatus body 100A is provided with an abutment member 80 which abuts against the shutter 70 when the developing apparatus 4 is inserted. The abutment member 80 is joined with an abutment urging spring 81, and can slide with respect to the apparatus body 100A. More specifically, the abutment member 80, which can slide with respect to the apparatus body 100A, abuts against the shutter 70 when the developing apparatus 4 is inserted; and pushes the shutter 70 toward a direction opposite to a direction toward which the urging force of the shutter urging member 71 is applied. In the present embodiment, the abutment urging spring 81, which is an abutment urging member, urges the abutment member 80 toward a direction opposite to the insertion direction of the developing apparatus 4. In other words, the direction toward which the abutment urging member 81 urges the abutment member 80 is opposite to the direction toward which the shutter urging spring 71 urges the shutter 70. An urging force Fb1 of the abutment urging spring 81 is larger than an urging force Fa1 of the shutter urging spring 71 produced when the shutter 70 is positioned at the closing position.

As illustrated in FIG. 5, when the developing apparatus 4 is inserted, the shutter 70 abuts against the abutment member 80. In a case where the shutter 70 is fixed to the developer container 41, by the fixing member 72, at the position at which the shutter 70 closes the discharge port 411, when the developing apparatus 4 is inserted, the abutment member 80 is pushed by the shutter 70 fixed to the developer container 41, and moved (retracted) against the urging force of the abutment urging spring 81 toward the insertion direction, following the developing apparatus 4. That is, when the developing apparatus 4 is inserted, the abutment urging spring 81 is contracted, without expansion of the shutter urging spring 71. Thus, when the developing apparatus 4 is inserted, the shutter 70 does not move relative to the developer container 41, and does not move from the closing position to the opening position. Consequently, the discharge port 411 is kept closed. That is, in a state where the developing apparatus 4 is attached to the apparatus body 100A, the abutment member 80 is positioned at a predetermined position (which allows the developing apparatus 4 to be attached to the apparatus body 100A) by the shutter 70 fixed at the closing position by the fixing member 72. Thus, if a user attaches the fixing member 72 to the developing apparatus 4 and inserts the developing apparatus 4 into the apparatus body 100A without removing the fixing member 72, the shutter 70 can be prevented from moving from the closing position to the opening position. In this case, the image forming apparatus 100 can be operated in the non-trickle system. When the image forming apparatus 100 is operated in the non-trickle system, the user has only to cause the supplying apparatus 8 to supply the supplying developer containing only the toner. Specifically, the user has only to attach a replacement bottle which contains the supplying developer containing only the toner, to the supplying apparatus 8.

Figure 6:
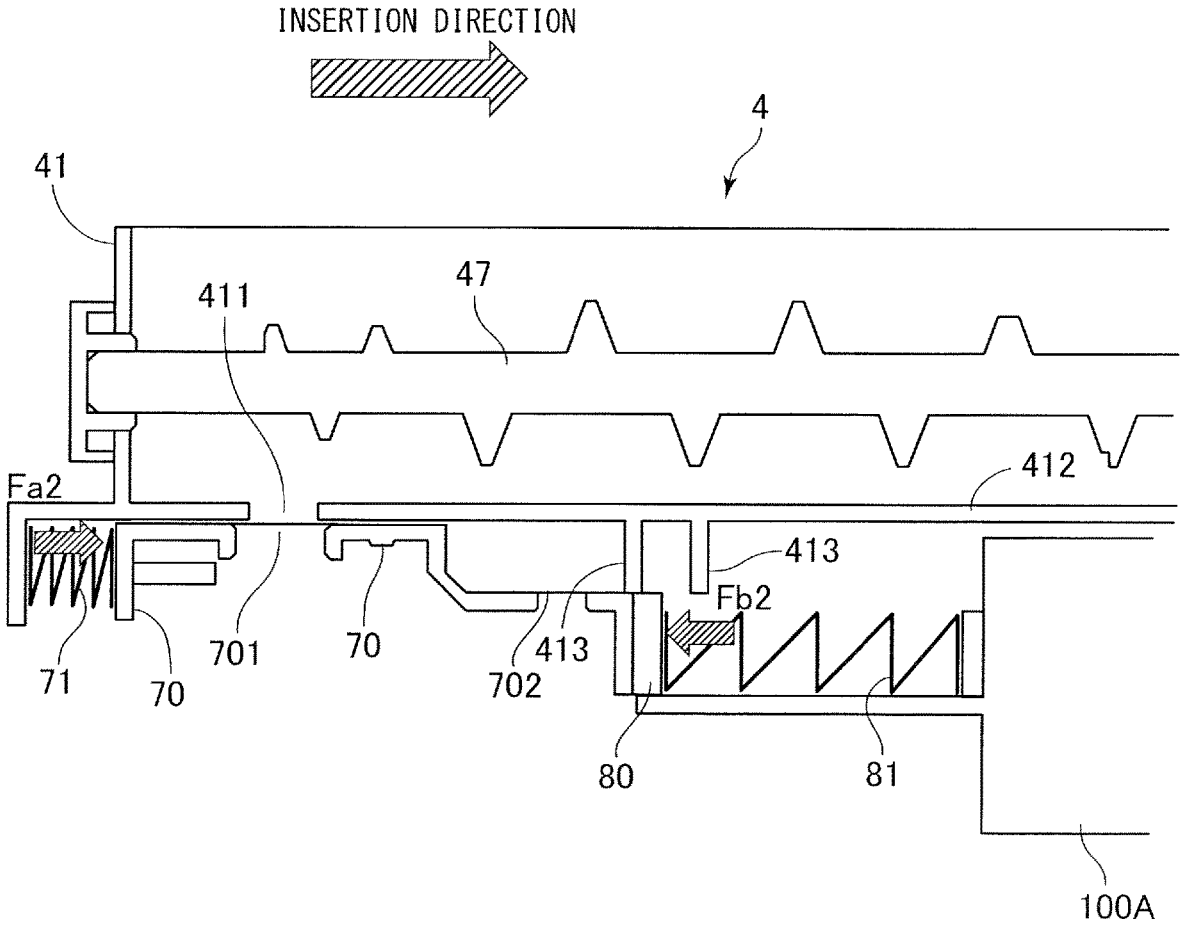
FIG. 6 is a diagram illustrating a shutter operation performed in a state where the fixing member is not attached.

As illustrated in FIG. 6, also in a case where the shutter 70 is not fixed to the developer container 41 by the fixing member 72 at the position at which the shutter 70 closes the discharge port 411, the abutment member 80 is pushed by the shutter 70 when the developing apparatus 4 is inserted. In this case, however, since an urging force Fb2 of the abutment urging spring 81 is larger than an urging force Fa2 of the shutter urging spring 71, the abutment urging spring 81 is not compressed, and the shutter urging spring 71 is contracted by the abutment member 80 via the shutter 70. Thus, when the developing apparatus 4 is inserted, the shutter 70 moves relative to the developer container 41, and moves from the closing position to the opening position. Consequently, the discharge port 411 is opened. That is, when the developing apparatus 4 is attached to the apparatus body 100A in a state where the fixing member 72 is not attached to the developer container 41, the shutter 70 is pushed and positioned at the opening position by the abutment member 80. Thus, if a user removes the fixing member 72 from the developing apparatus 4 and inserts the developing apparatus 4 into the apparatus body 100A, the shutter 70 is allowed to move from the closing position to the opening position. In this case, the image forming apparatus 100 can be operated in the trickle system. When the image forming apparatus 100 is operated in the trickle system, the user has only to cause the supplying apparatus 8 to supply the supplying developer containing the toner and the carrier. Specifically, the user has only to attach a replacement bottle which contains the supplying developer containing the toner and the carrier, to the supplying apparatus 8.

As described above, in the present embodiment, before attaching the developing apparatus 4, a user can select any one of the state in which the discharge port 411 is opened to achieve the trickle system, and the state in which the discharge port 411 is closed to achieve the non-trickle system, by attaching or removing the fixing member 72. If the image forming apparatus 100 is operated in the trickle system, excess developer which contains deteriorated carrier will be discharged from the discharge port 411 while the supplying developer will be supplied. As a result, the developer can be maintained in a state where the developer hardly causes image defects for a long time, and the stability of image can be ensured in the image formation. In contrast, if the image forming apparatus 100 is operated in the non-trickle system, the carrier, which is more expensive than the toner, needs not to be supplied. As a result, the increase in running costs caused by supplying the carrier can be suppressed. Thus, a user can select any one of the trickle system and the non-trickle system, which have different features such as image stability and cost reduction, by performing the simple operation such as attaching or removing the fixing member 72. In addition, since the trickle system and the non-trickle system can be achieved on the single image forming apparatus 100, the image forming apparatus 100 has high usability and multiplicity of use. Thus, the present embodiment can provide the simple structure of the image forming apparatus 100 that can selectively achieve the trickle system and the non-trickle system, and that allows the image forming apparatus 100 to have high usability.

Second Embodiment

Next, a developing apparatus 4A of a second embodiment will be described with reference to FIG. 7. The developing apparatus 4A of the second embodiment differs from the developing apparatus 4 of the first embodiment (see FIG. 4) in that the developing apparatus 4A includes a shielding member 90 instead of the fixing member 72. The other configuration of the developing apparatus 4A may be the same as that of the developing apparatus 4. Thus, in the below-described second embodiment, a component identical to a component of the first embodiment is given an identical symbol, and the description thereof will be simplified or omitted.

Figure 7:
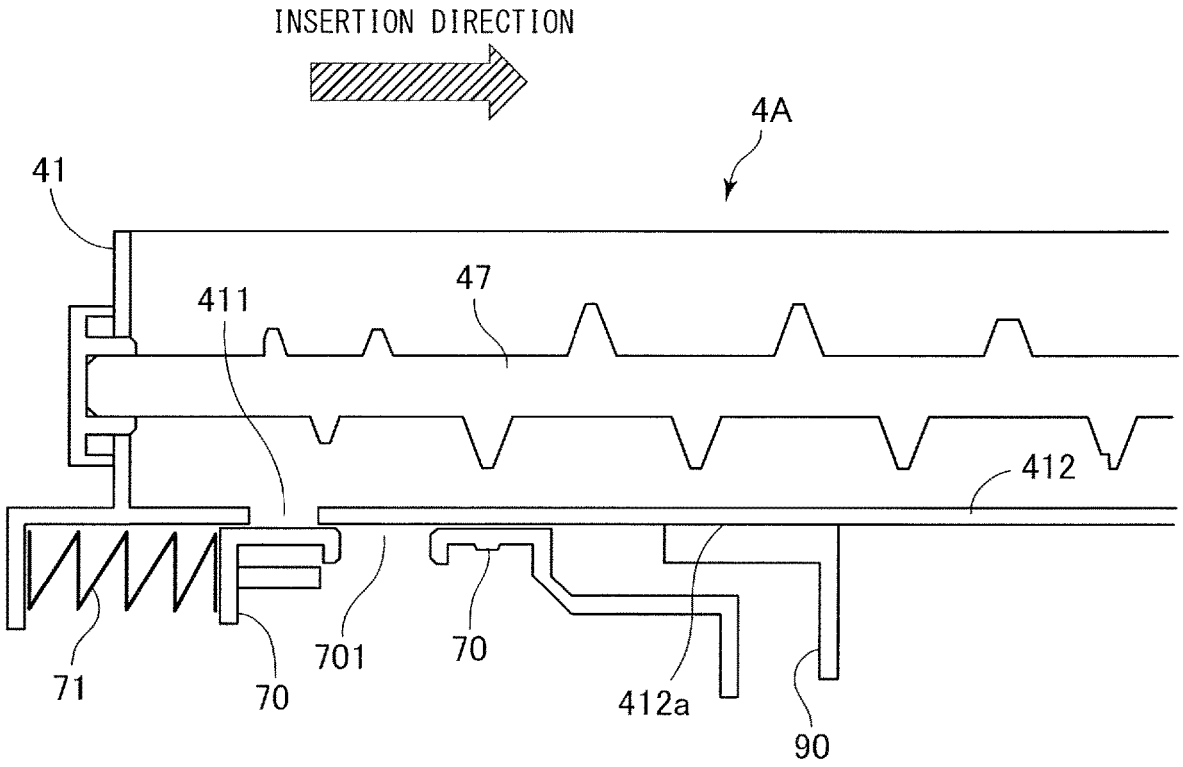
FIG. 7 is an enlarged cross-sectional view illustrating a developing apparatus of a second embodiment.

As illustrated in FIG. 7, the developing apparatus 4A of the second embodiment includes the shielding member 90 formed on the bottom portion 412 of the developer container 41. The shielding member 90 serving as a movement restricting member (a restricting member) is formed downstream from the shutter 70, positioned at the closing position, in the insertion direction of the developing apparatus 4A. The shielding member 90 is detachably attached to the developer container 41 via an attachment portion 412*a*. As described later, when the shielding member 90 is attached to developer container 41, the shielding member 90 retains the shutter 70 at the position at which the shutter 70 closes the discharge port 411. In contrast, when the shielding member 90 is not attached to the developer container 41, the shutter 70 is allowed to move from the closing position toward the opening position when the developing apparatus 4 is inserted. When the developing apparatus 4A is not inserted in a state where the shielding member 90 is not attached to the developer container 41, the discharge port 411 is closed by the shutter 70. Thus, the shielding member 90 is a switching member, which switches the state of the shutter 70 between a state where the shutter 70 can move to the opening position when the developing apparatus 4A is inserted, and a state where the shutter 70 is retained at the closing position when the developing apparatus 4A is inserted. In other words, the shielding member 90 is a fixing member disposed so that the shutter 70 is positioned, in the moving direction of the shutter 70, between the shutter urging spring 71, which is a shutter urging member, and the shielding member 90, which is an obstructing member. The shutter 70 is urged by the shutter urging spring 71 so that the shutter 70 is positioned at the closing position between the shutter urging spring 71 and the shielding member 90. Further in other words, the shielding member 90 is a movement restricting member (a restricting member) which is interposed between the shutter 70 and the abutment member 80 in the moving direction of the shutter 70, and which restricts the abutment member 80 from moving to a position which allows the shutter 70 to be positioned at the opening position, when the developing apparatus 4A is attached to the apparatus body 100A. In the present embodiment, the abutment member 80 is a movable member, and the shielding member 90 is a positioning member to position the abutment member 80. That is, the shielding member 90 is a restricting member detachably attached to the developing apparatus 4A and configured to restrict the abutment member 80 from being positioned at such a position that the abutment member 80 moves the shutter 70 to the opening position when the developing apparatus 4A is attached to the apparatus body 100A.

Here, since the present embodiment does not include the fixing member 72, the fixing hole 702 (see FIG. 4) is not formed in the shutter 70, and the fitting portion 413 (see FIG. 4) is not formed on the developer container 41.

Figure 8:
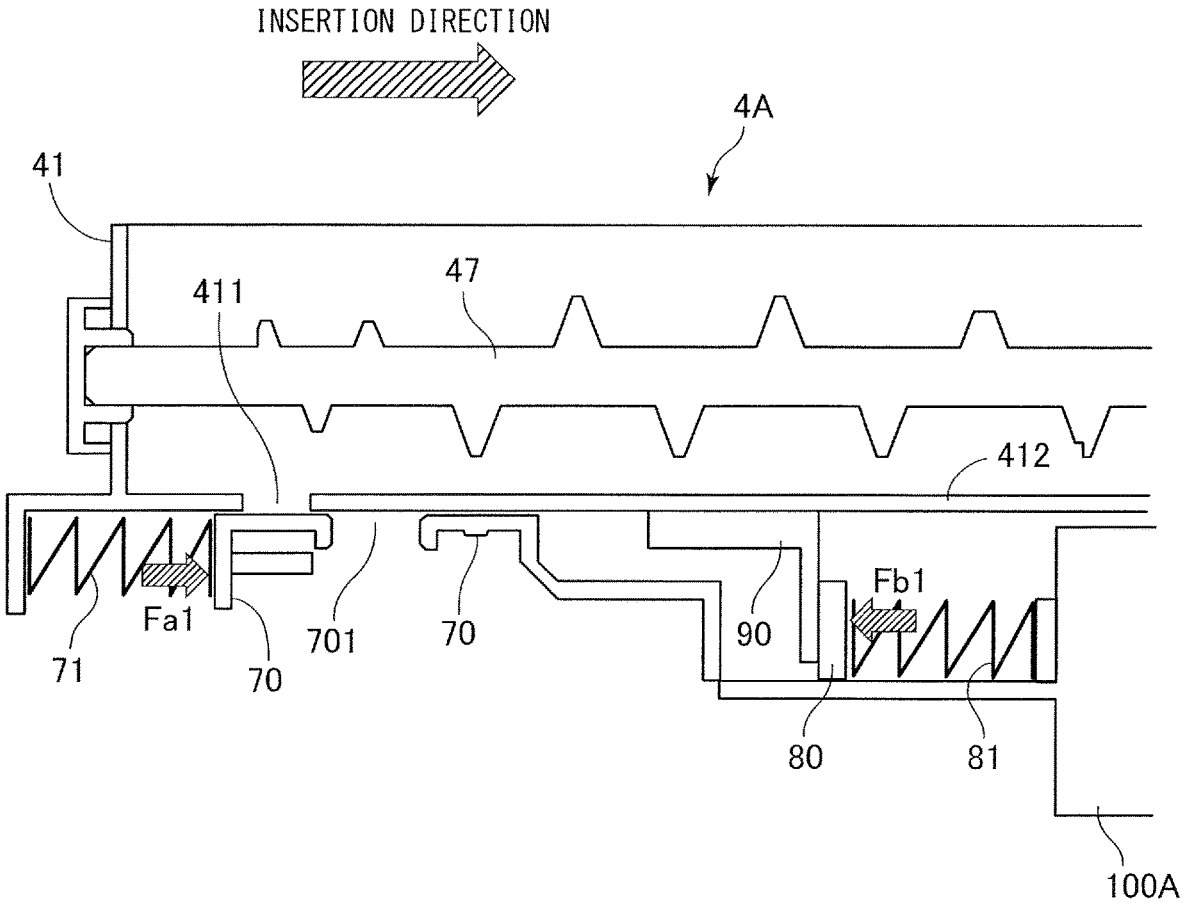
FIG. 8 is a diagram illustrating a shutter operation performed in a state where a shielding member is attached.

Next, an operation of the shutter 70 of the developing apparatus 4A will be described with reference to FIGS. 8 and 9. FIG. 8 illustrates a shutter operation performed in a state where the shielding member 90 is attached, and FIG. 9 illustrates a shutter operation performed in a state where the shielding member 90 is not attached.

As illustrated in FIG. 8, when the developing apparatus 4A is inserted in the state where the shielding member 90 is attached, not the shutter 70 but the shielding member 90 abuts against the abutment member 80. That is, when the developing apparatus 4A is inserted, the shielding member 90 abuts against the abutment member 80 ahead of the shutter 70. Thus, the abutment member 80 is pushed and moved (retracted) toward the insertion direction against the urging force of the abutment urging spring 81, following the developing apparatus 4A. Thus, when the developing apparatus 4 is inserted, the shutter 70 does not move relative to the developer container 41, and does not move from the closing position to the opening position. Consequently, the discharge port 411 is kept closed. That is, the shutter 70 is retained at the position at which the shutter 70 closes the discharge port 411. Thus, if a user attaches the shielding member 90 to the developing apparatus 4 and inserts the developing apparatus 4A into the apparatus body 100A without removing the shielding member 90, the shutter 70 can be prevented from moving from the closing position to the opening position. In this case, the image forming apparatus 100 can be operated in the non-trickle system.

Figure 9:
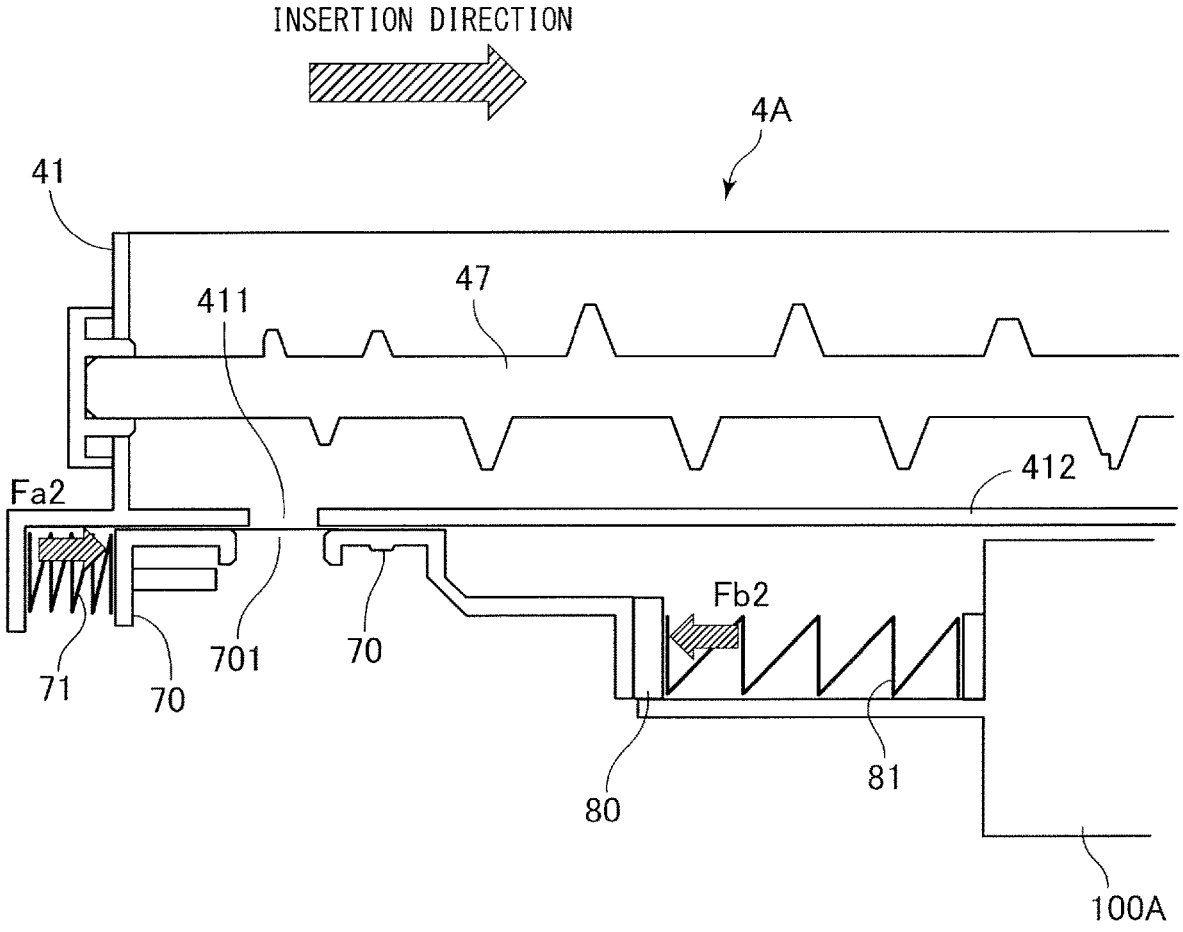
FIG. 9 is a diagram illustrating a shutter operation performed in a state where the shielding member is not attached.

As illustrated in FIG. 9, when the developing apparatus 4A is inserted in the state where the shielding member 90 is not attached, the shutter 70 abuts against the abutment member 80. In this case, however, since an urging force Fb2 of the abutment urging spring 81 is larger than an urging force Fa2 of the shutter urging spring 71, the abutment urging spring 81 is not contracted, and the shutter urging spring 71 is contracted by the abutment member 80 via the shutter 70. Thus, when the developing apparatus 4A is inserted, the shutter 70 moves relative to the developer container 41, and moves from the closing position to the opening position. Consequently, the discharge port 411 is opened. Thus, if a user removes the shielding member 90 from the developing apparatus 4A and inserts the developing apparatus 4 into the apparatus body 100A, the shutter 70 is allowed to move from the closing position to the opening position. In this case, the image forming apparatus 100 can be operated in the trickle system.

As described above, in the second embodiment, before attaching the developing apparatus 4, a user can select any one of the state in which the discharge port 411 is opened to achieve the trickle system, and the state in which the discharge port 411 is closed to achieve the non-trickle system, by attaching or removing the shielding member 90. Thus, a user can select any one of the trickle system and the non-trickle system by performing the simple operation such as attaching or removing the shielding member 90. In addition, since the trickle system and the non-trickle system can be achieved on the single image forming apparatus 100, the image forming apparatus 100 has high usability and multiplicity of use. Thus, the second embodiment can produce the same effect as that of the first embodiment, in which there is provided the simple structure of the image forming apparatus 100 that allows a user to selectively achieve the trickle system and the non-trickle system, and that allows the image forming apparatus 100 to have high usability.

Modifications

In the first and the second embodiments, the abutment member 80 is retracted toward the insertion direction of the developing apparatus 4 (4A). The present disclosure, however, is not limited to this. For example, the abutment member 80 may be an elastic member such as a plate spring, and attached to the apparatus body 100A so as to extend toward a direction orthogonal to the insertion direction of the developing apparatus 4 (4A). In this case, when the developing apparatus 4 (4A) is inserted, the abutment member 80 is retracted, while being deformed, by the shutter 70 fixed to the developer container 41 at the closing position by the fixing member 72 or the shielding member 90.

In the second embodiment, the shielding member 90 is detachably attached to the developer container 41. The present disclosure, however, is not limited to this. For example, the shielding member 90 may not be provided. In this case, the abutment member 80 may be detachably attached to the apparatus body 100A and not urged, and the position of the abutment member 80 may be changed. If the abutment member 80 is attached to the apparatus body 100A at a position located downstream in the insertion direction of the developing apparatus 4A, the shutter 70 will not abut against the abutment member 80, and will be retained at the closing position. In construct, if the abutment member 80 is attached to the apparatus body 100A at a position located upstream in the insertion direction of the developing apparatus 4A, the shutter 70 will abut against the abutment member 80, and will be moved from the closing position to the opening position.

The shielding member 90 may not be detachably attached to the developer container 41. For example, the shielding member 90 may be folded by a user. In this case, when the developing apparatus 4 is inserted in a state where the shielding member 90 is folded, the abutment member 80 abuts against not the shielding member 90 but the shutter 70, and the shutter 70 is moved from the closing position to the opening position. In contrast, when the developing apparatus 4 is inserted in a state where the shielding member 90 is not folded, the abutment member 80 abuts against the shielding member 90, and the shutter 70 is retained at the closing position. In the above-described embodiments, the description has been made for the case where the system can be switched between the trickle system and the non-trickle system in the image forming apparatus. However, since the image forming apparatus of the present invention can use any of the trickle system and the non-trickle system, the present invention may be applied to an image forming apparatus which uses only one of the trickle system and the non-trickle system. Thus, the standardization of components between the developing apparatus (image forming apparatus) with the trickle system and the developing apparatus (image forming apparatus) with the non-trickle system can be achieved. Here, even when the standardization is achieved, the obstructing member will not be attached to the image forming apparatus when the trickle system is used, and will be attached to the image forming apparatus when the non-trickle system is used. In addition, in the image forming apparatus with the trickle system, the abutment member 80 may not be provided. Furthermore, the obstructing member may be detachably attached to the apparatus body of the image forming apparatus.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-079407, filed Apr. 17, 2018, which is hereby incorporated by reference herein in its entirety.

What is claimed is:

1. An image forming apparatus, comprising:

a developing apparatus which is insertable to the image forming apparatus, the developing apparatus comprising:

a developer container configured to accommodate developer containing toner and carrier;

a developer discharging portion configured to discharge a part of the developer accommodated in the developer container;

a shutter arranged relatively movably to the developer container and configured to move between a closing position at which the shutter closes the developer discharging portion and an opening position at which the shutter opens the developer discharging portion;

a first spring joined with the shutter and configured to urge the shutter in an insertion direction in which the developing apparatus is inserted to the image forming apparatus so the shutter is maintained at the closing position;

a fixing member detachably attached to the developing apparatus and configured to fix the shutter at the closing position;

an attachment portion provided in the developing apparatus and to which the fixing member is attached;

an engagement member configured to engage with the shutter; and a second spring joined with the engagement member and configured to urge the engagement member in a direction opposite to the insertion direction, wherein, in a case where the fixing member is attached to the attachment portion, the shutter urged by the first spring engages with the engagement member urged by the second spring in accordance with an insertion operation of inserting the developing apparatus to the image forming apparatus and is maintained at the closing position, and in a case where the fixing member is not attached to the attachment portion, the shutter urged by the first spring engages with the engagement member urged by the second spring in accordance with the insertion operation and moves from the closing position to the opening position.

2. The image forming apparatus according to claim 1, wherein in the case where the fixing member is attached to the attachment portion, an urging force of the second spring for urging the engagement member in a state in which the shutter urged by the first spring engages with the engagement member urged by the second spring in accordance with the insertion operation is smaller than an urging force of the first spring for urging the shutter.

3. The image forming apparatus according to claim 1, wherein in the case where the fixing member is not attached to the attachment portion, an urging force of the second spring for urging the engagement member in a state in which the shutter urged by the first spring engages with the engagement member urged by the second spring in accordance with the insertion operation is larger than an urging force of the first spring for urging the shutter.

* * * * *